US005169175A

United States Patent [19]

Jerkunica

[11] Patent Number: 5,169,175

[45] Date of Patent: Dec. 8, 1992

[54] PAGE VIEWER

[76] Inventor: Marinko M. Jerkunica, 1359-A Cliff Dr., Laguna Beach, Calif. 92651

[21] Appl. No.: 598,998

[22] Filed: Oct. 17, 1990

[51] Int. Cl.[5] ..... B42F 21/00

[52] U.S. Cl. ..... 283/36; 283/41

[58] Field of Search ..... 283/36, 37, 38, 41, 283/42, 43

[56] References Cited

U.S. PATENT DOCUMENTS

| | | | |
|---|---|---|---|
| 404,294 | 5/1889 | Lester . | |
| 629,214 | 7/1899 | Simpson . | |
| 1,026,804 | 5/1912 | Hare . | |
| 1,222,568 | 4/1917 | Smith . | |
| 2,288,066 | 6/1942 | Bloom . | |
| 2,680,630 | 4/1949 | Machol . | |
| 4,050,719 | 9/1977 | Cunningham | 283/36 |
| 4,949,999 | 8/1990 | Ke-hui . | |
| 4,966,285 | 10/1990 | Otake et al. | 283/36 X |

FOREIGN PATENT DOCUMENTS

| | | |
|---|---|---|
| 373015 | 12/1963 | Switzerland . |
| 8418 | of 1912 | United Kingdom . |

*Primary Examiner*—Timothy V. Eley
*Assistant Examiner*—Willmon Fridie, Jr.

[57] ABSTRACT

A marking system is disclosed which is used for locating desired text on a first page of textual material. A small-scale locator symbol on a second page of textual material defines an image which represents the first page. The symbol also includes visually perceptible markings which represent the positioning of the desired text on the first page such that a reader, by briefly glancing at the symbol, may learn in advance where on the first page the desired text is located.

20 Claims, 2 Drawing Sheets

FIG. 1
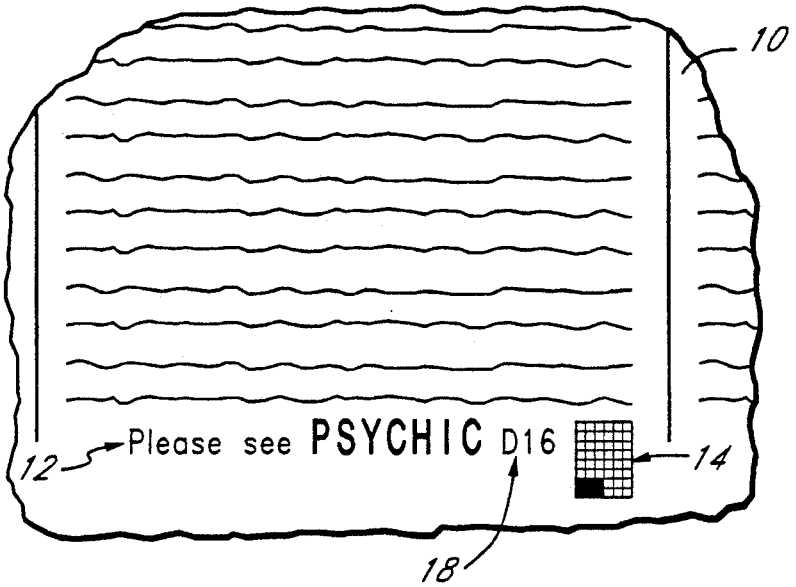
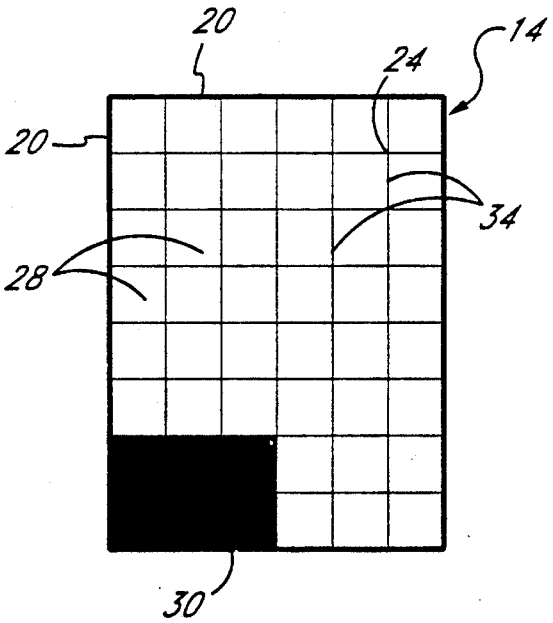
FIG. 2

PAGE VIEWER

FIELD OF THE INVENTION

The present invention relates to a marking system used for locating the position of desired text on a page of textual material.

BACKGROUND OF THE INVENTION

With regard to newspapers, magazines, books, instruction manuals, encyclopedias, information research tools, legal documents, as well as other forms of information-containing reference material, it is commonly necessary to refer a reader to text in a different section or page of the same or another reference material. Most commonly, the reader is provided with a page number in the reference to refer to where the reader may find the desired text continued on that page. However, once the reader has successfully located the referenced page in the appropriate newspaper, magazine, book, document, or other reference, the reader is then required to search the contents of the page in order to locate the text which he is desirous of reading.

For example, with regard to newspapers, a reader is often referred to a different page in a newspaper wherein a continuation segment of a desired article is located. Once the reader turns to the appropriate page, he is then required to search the entire page of the newspaper in order to locate the desired text. Often, the reader has forgotten the title of the subject article and must scan the text of potentially numerous article segments on that page in order to successfully locate the desired article segment.

One may find patents in the prior art which teach methods for assisting a reader of a book, for example, in locating a desired page in the book which contains desired text. Examples of these are found in U.S. Pat. Nos. 2,680,630; 1,222,568; 1,026,804; 629,214 and 404,294. These systems, however, only assist the reader in finding a desired page. Once the appropriate page has been found, the reader must still scan or search the page for desired text. The present invention seeks to remedy this deficiency by providing a method whereby a reader may easily locate desired text or other material on a page once the appropriate page has been found.

SUMMARY OF THE INVENTION

The present invention provides a reader with a means for quickly and easily locating desired text on a page of a newspaper, magazine, book, instruction manual, encyclopedia, or other reference, to which page the reader has been referred to by, for example, a page reference in text on a previous page. When, in such a reference, it is desired to refer a reader to text on a different page, the present invention teaches that a small scale visual representation of the page being referred to, or continuation page, is printed adjacent the location where the page forwarding reference occurs. This visual representation preferably takes the form of a small rectangular box, or locator box, having a grid pattern inscribed therewithin. The box has a shape representing and corresponding to the page on which the desired text is located. In accordance with this invention, smaller squares or rectangles defined by the grid are darkened corresponding to the location and positioning of the desired text on the continuation page to which the reader is referred. The continuation page is most often identified on the earlier page of the reference at the end of the relevant text on that page (for example, "see page A13"). The locator box is preferably located adjacent the continuation page reference.

By briefly glancing at the darkened regions in the locator box, the reader is informed in advance as to the location of the desired text on the continuation page to which the reader is referred. Thus, once the reader turns to the appropriate continuation page, he will know exactly where on that page the desired text is located. The reader is therefore spared the time of searching the entire area of the page for the desired text. Similarly, the invention may also function in reverse so as to refer a reader to a previous page containing a previous or earlier segment of an article. The present invention also includes a method for assisting a reader in locating desired text on a page including the steps of providing an image representing the page and providing markings representing the desired text.

BRIEF DESCRIPTION OF THE DRAWINGS

FIG. 1 is a top plan view of a portion of a newspaper article segment illustrating a preferred use of a locator symbol of the present invention.

FIG. 2 is an enlarged view of the locator symbol shown in FIG. 1.

DESCRIPTION OF THE PREFERRED EMBODIMENT

Figure 3:
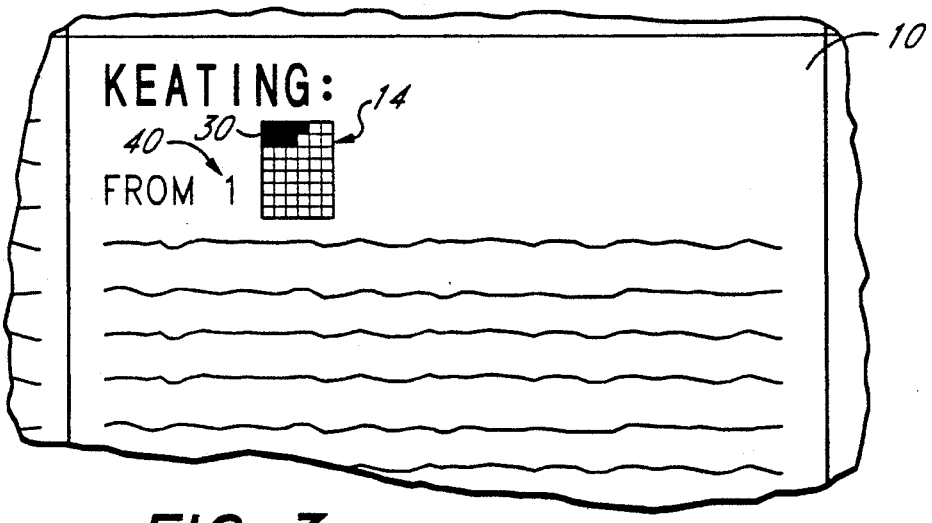
FIG. 3 is a top plan view of a portion of a newspaper continuation article segment on a continuation page showing use of a locator symbol to refer to a previous article segment on an earlier page.

In accordance with the present invention, a locator symbol is provided which is a visually perceptible, small-scale representation of a page containing textual material and desired text on that page. Such textual material may include, for example, written words, charts, graphs, pictures, drawings, or any other form of visually perceptible material.

Referring to FIG. 1 of the drawings, a portion of a newspaper article segment is shown. Use of this invention in a newspaper, however, is only by way of example, and application of this invention is not deemed to be limited thereto but rather is deemed to be equally useful with regard to magazines, encyclopedias, instruction manuals, legal documents, research reference materials, etc. The portion of the segment shown is the last text of an article segment appearing on a page 10 of the newspaper. As can be seen, the text is in columnar format.

After the last line of text on the page 10, a continuation page reference 12 is printed, namely "Please see PSYCHIC D16." Adjacent and to the right of the page reference 12 is located a small locator symbol which, in this illustration, is in the form of a rectangular locator box 14. Referring to FIG. 2, the locator box 14 serves as a small-scale, visual representation of a continuation page 18 on which the subject newspaper article is continued, and includes an outline or image 20 of the edges of the text-containing area of the continuation page 18. The locator box 14 also includes markings which visually represent the positioning of the text of the continued article segment, or desired text, on the continuation page 18. Such markings may be placed in any manner internal and/or external to the image 20 to represent the positioning of the desired text.

In the preferred embodiment, the area inside the locator box 14 includes a grid 24 which is inscribed within the image 20. The grid 24 defines an array of smaller boxes or grid sectors 28. By way of example, several of the grid sectors 28 in the locator box 14 illustrated in FIG. 2 are darkened or shaded. Adjacent darkened portions of grid sectors 28 together form a shaded region 30. In accordance with this invention, the shaded region 30 visually represents the horizontal and vertical columnar positioning of the continuation article segment on the continuation page 18.

Preferably, to conserve space, the empty side, top, and bottom margins of the continuation page 18 are not represented by the image 20 defined by the locator box 14. Rather, only the outer edges of the textual material on the continuation page 18 are represented by the image 20. Preferably, vertical edges 34 of the grid sectors 28 represent corresponding edges or divisions between typesetting columns used in the newspaper, although this is not necessary.

As can be seen in FIG. 1, the continuation page reference 12 directs the reader of the article to turn to the continuation page 18, in this case page D16, to continue reading the article in the continuation article segment on the continuation page 18. By glancing at the shaded region 30 in the locator box prior to turning to the continuation page 18, a reader will learn in advance where on the continuation page 18 the continuation article segment is positioned.

The present invention functions equally well in reverse. Referring to FIG. 3, when a reader wishes to refer back to a previous article segment, from which a continuation article segment is continued, an appropriately shaded locator symbol, e.g., locator box 14, preferably positioned at the beginning of the continuation article segment, may be employed to indicate the position of the previous article segment on an earlier page 40. In this manner, a reader may refer back to a prior article segment in order to refresh his memory or to reread that portion of the article.

OTHER EMBODIMENTS

The present invention is not limited to the embodiment described above but rather may take many forms and may operate in a variety of ways. Several of these are described herein.

Figure 4:
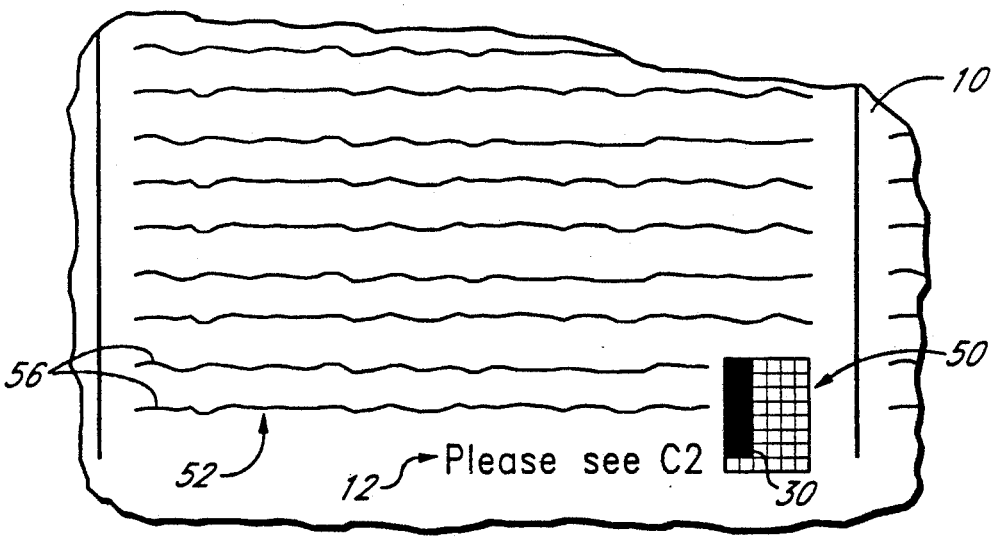
FIG. 4 is a top plan view of a portion of a newspaper article segment illustrating a locator symbol recessed into the textual material of the article.

Although it is preferred that the locator symbol be small enough in size to allow it to be positioned adjacent the continuation page reference 12 below the last text of an article segment, it may be desirable to make the locator symbol larger to increase its readability. Referring to FIG. 4, this could be accomplished by placing an enlarged locator box 50 in the bottom right-hand corner of the article segment such that the box 50 is recessed into the textual material 52. In this case, the last several lines 56 of the article would be shortened to allow room for insertion of the locator box 50.

As is often the case, the last line of a paragraph in an article segment ends before reaching the right margin of the line, and the remaining space on that line remains unused. In these instances, therefore, the locator box 50 may be made larger without increasing the size of the article because the empty space to the right of the end of the last line of text is consumed by the expanded text rather than moving the text onto a new line.

Positioning of text on a continuation page 18 may be communicated to the reader in a variety of ways. Rather than providing a shaded grid 24, a shaded region without a grid 24, cross-hatching of regions within the locator symbol, dots positioned within the symbol corresponding to location of text on the continuation page 18, as well as any other form of markings may be used to visually represent the orientation of desired text on a continuation page 18. Portions of the markings may also be colored either for aesthetic purposes or, possibly, to convey additional information to the reader such as paragraph locations or locations of particular words or other textual material on a specific topic within the desired text. Further, the markings may be raised from the surface of a page, for example raised dots, so that they may be perceived by the blind. Additionally, although the shape of the locator symbol is most often rectangular, the box may take any shape desired to correspond to the shape of the continuation page 18.

In one use, a locator box 14 may be placed adjacent topic indicators in, for example, the table of contents in a reference manual, computer software user's guide, or other such reference material. In this manner, the location of text, drawings, charts, etc. on a page of such a manual or guide may be communicated in advance to the reader. In addition, multiple locator boxes 14 can be used to indicate the location of relevant text on multiple pages of the reference. Particular words or other textual material which are referred to in the table of contents may be underlined, highlighted, or otherwise brought to the reader's attention on the continuation page 18.

Locator symbols may also be used in non book/-magazine-related applications. For example, a locator symbol may be used in a map adjacent street names in the street index to represent the position of the desired street on a given zone or grid of the map's coordinate system. This would greatly facilitate locating a desired street or other landmark on the zone or grid. Further, locator symbols could be used on shopping mall directories adjacent the names of stores, etc. to show the location of a given store relative to the floor plan of the mall.

Having described the invention in connection with certain specific embodiments thereof, it is to be understood that further modifications may now suggest themselves to those skilled in the art, and it is intended to include such modifications as fall within the scope of the appended claims.

I claim:

1. A marking system for aiding a viewer in locating desired text on the face of a first page containing textual material, said marking system comprising a locator box on a second page wherein said locator box is a small-scale visual representation of said first page, said locator box comprising:

a rectangular border representing the outer edges of said textual material on said first page; and a shaded region within said locator box, said shaded region being marked within said locator box in a position representing and corresponding to the position of said desired text on said first page such that said viewer may learn the position of said desired text on said first page by viewing said representative shaded region in said locator box.

2. The marking system as defined in claim 1, wherein said locator box has a grid inscribed therewithin, said grid defining grid sectors within said locator box.

3. The marking system as defined in claim 2, wherein said grid sectors have vertical edges which represent columnar divisions in said textual material on said first page.

4. A marking system used for locating desired text in an area containing textual material, said marking system comprising a locator symbol wherein said symbol assists in locating the position of said desired text in said area by including recognizable markings which visually represent, in small-scale, the physical position of said desired text in said area relative to a boundary of said area, said locator further includes an outer edge, said outer edge representing said boundary of said area, and the position of said markings relative to said outer edge corresponds to the position of said desired text relative to said boundary.

5. The marking system as defined in claim 4, wherein said area is a zone on a map and wherein said markings in said locator symbol represent desired landmarks in said zone.

6. A marking system used for locating desired text on a first page containing textual material, said marking system comprising a locator symbol on a second page wherein said locator symbol comprises:

an image on said second page, said image representing and corresponding to the shape of said first page; and markings which represent the position of said desired text on said first page.

7. The marking system as defined in claim 6, wherein said image is rectangular in shape corresponding to a rectangular shape of said first page.

8. The marking system as defined in claim 6, wherein said markings are located entirely within said image, said markings positionally corresponding, with respect to said image, to the position of said desired text.

9. The marking system as defined in claim 8, wherein said markings comprise shaded regions.

10. The marking system as defined in claim 6, wherein said first page contains textual material pertaining to a plurality of topics, said desired text pertaining to one of said topics.

11. The marking system as defined in claim 6, wherein said image represents the outer edges of said textual material on said first page.

12. The marking system as defined in claim 6, wherein said locator symbol is situated proximal a page reference on said second page which refers a reader to said first page.

13. The marking system as defined in claim 12, wherein said second page contains textual material which is continued on said first page and wherein said locator symbol refers said reader to said desired text on said first page, said desired text being the continuation of said textual material on said second page.

14. The marking system as defined in claim 6, wherein said locator symbol is positioned proximal a topic indicator on said second page wherein said topic indicator refers to the subject matter of desired text represented by said markings.

15. The marking system as defined in claim 14, wherein certain words or portions of said desired text on said first page are marked to visually set apart said words or portions from said desired text.

16. The marking system as defined in claim 6, wherein said image is recessed into textual material on said second page.

17. The marking system as defined in claim 6, wherein said markings are multi-colored such that additional information may be communicated to the reader via respective distinguishable colorings of the markings.

18. A page having textual material thereon and a locator box on said page in the form of a small-scale representation of a continuation page, said box having markings thereon to direct a reader to desired text on said continuation page.

19. A method of assisting a reader in locating the position of desired text on a first page containing textual material comprising the step of applying onto a second page a symbol which visually represents and corresponds to said first page and which communicates to a reader the position of desired text on said first page, said applying step including the steps of:

applying onto said second page an image which represents and corresponds to the shape of said first page; and applying markings to said image on said second page which visually represent the position of said desired text on said first page.

20. The method as defined in claim 19, wherein said step of applying markings comprises shading regions within said image, said regions proportionally representing relative to said image the position of said desired text relative to an outer edge of textual material on said first page.

* * * * *